US010092786B2

(12) United States Patent
Yao et al.

(10) Patent No.: US 10,092,786 B2
(45) Date of Patent: Oct. 9, 2018

(54) FIRE EXTINGUISHING COMPOSITION COMPRISING ALDOKETONES COMPOUND

(71) Applicant: Xi'an Westpeace Fire Technology Co., Ltd., Xi'an Shaanxi (CN)

(72) Inventors: Junna Yao, Xi'an Shaanxi (CN); Yi Liu, Xi'an Shaanxi (CN); Zhanjun Yang, Xi'an Shaanxi (CN); Gaofeng Zheng, Xi'an Shaanxi (CN); Zhengjun Lei, Xi'an Shaanxi (CN)

(73) Assignee: XI'AN WESTPEACE FIRE TECHNOLOGY CO., LTD., Xi'An Shaanxi (CN)

( * ) Notice: Subject to any disclaimer, the term of this patent is extended or adjusted under 35 U.S.C. 154(b) by 0 days.

(21) Appl. No.: 15/111,174

(22) PCT Filed: Mar. 11, 2015

(86) PCT No.: PCT/CN2015/074044

§ 371 (c)(1),
(2) Date: Jul. 12, 2016

(87) PCT Pub. No.: WO2015/104006

PCT Pub. Date: Jul. 16, 2015

(65) Prior Publication Data

US 2016/0332016 A1 Nov. 17, 2016

(30) Foreign Application Priority Data

Jan. 13, 2014 (CN) ..... 2014 1 0014400

(51) Int. Cl.
*A62D 1/06* (2006.01)

(52) U.S. Cl.
CPC ..... *A62D 1/06* (2013.01)

(58) Field of Classification Search
CPC ..... A62D 1/06
See application file for complete search history.

(56) References Cited

U.S. PATENT DOCUMENTS

| | | | |
|---|---|---|---|
| 4,665,993 | A | 5/1987 | Balassa |
| 5,520,826 | A | 5/1996 | Reed, Jr. et al. |
| 8,257,607 | B1 | 9/2012 | Johnson et al. |
| 8,778,213 | B2 | 7/2014 | Guo et al. |
| 8,871,110 | B2 | 10/2014 | Guo et al. |
| 9,662,522 | B2 | 5/2017 | Liu et al. |
| 9,974,992 | B2 | 5/2018 | Zhang et al. |
| 2002/0137875 | A1 | 9/2002 | Reed et al. |
| 2003/0010508 | A1 | 1/2003 | Greiner |
| 2009/0069496 | A1 | 3/2009 | Sortwell |
| 2013/0221264 | A1 | 8/2013 | Guo et al. |
| 2014/0183399 | A1 | 7/2014 | Yao et al. |
| 2014/0374641 | A1 | 12/2014 | Liu et al. |
| 2016/0332014 | A1 | 11/2016 | Shi et al. |
| 2016/0332015 | A1 | 11/2016 | Zhang et al. |
| 2017/0043196 | A1 | 2/2017 | Wu et al. |

FOREIGN PATENT DOCUMENTS

| | | | |
|---|---|---|---|
| CN | 102179027 | A | 9/2011 |
| CN | 102824715 | A | 12/2012 |
| CN | 102861409 | A | 1/2013 |
| CN | 102949802 | A | 3/2013 |
| CN | 102949803 | A | 3/2013 |
| CN | 103111035 | A | 5/2013 |
| CN | 103170082 | A | 6/2013 |
| CN | 103736236 | A | 4/2014 |
| CN | 103736237 | A | 4/2014 |
| CN | 103736239 | A | 4/2014 |
| CN | 103785130 | A | 5/2014 |
| KR | 20060092192 | A | 8/2006 |
| WO | WO 2009/032587 | A1 | 3/2009 |
| WO | WO 2012/034492 | A1 | 3/2012 |
| WO | 2012154768 | A2 | 11/2012 |
| WO | WO 2015/104004 | A1 | 7/2015 |
| WO | WO 2015/104005 | A1 | 7/2015 |

(Continued)

OTHER PUBLICATIONS

Chemspider, The free chemical database, "Benzophenone", Oct. 23, 2012.*

(Continued)

*Primary Examiner* — Peter F Godenschwager
(74) *Attorney, Agent, or Firm* — Hamilton, Brook, Smith & Reynolds, P.C.

(57) ABSTRACT

The present invention relates to a fire-extinguishing composition containing an aldehyde/ketone compound. The fire-extinguishing composition releases a great quantity of active fire-extinguishing particles by making use of the heat generated from combustion of a pyrotechnic agent. The fire-extinguishing composition containing an aldehyde/ketone compound in the present invention reacts at a high temperature to generate free radicals and takes reaction with one or more of O-, OH-, H-free radicals necessary for a chain combustion reaction through the free radicals, so as to cut off the chain combustion reaction and take physical and chemical inhibiting effects to jointly achieve a fire extinguishing effect at the same time. Meanwhile, it takes synergistic interaction effects with the pyrotechnic agent to further raise the fire extinguishing efficiency of the fire extinguishing agent and greatly shorten the effective fire extinguishing time.

7 Claims, No Drawings

(56) References Cited

FOREIGN PATENT DOCUMENTS

| | | |
|---|---|---|
| WO | WO 2015/104006 A1 | 7/2015 |
| WO | WO 2015/104007 A2 | 7/2015 |

OTHER PUBLICATIONS

Ge et al., English abstract of CN 102993626 (Mar. 27, 2013).*
PCT/CN2015/074033 English Translation of the International Preliminary Report on Patentability dated Jul. 19, 2016 entitled "Fire Extinguishing Composition Comprising Carboxylic Acid Derivative."
PCT/CN2015/074033 English Translation of the International Search Report dated May 29, 2015 entitled "Fire Extinguishing Composition Comprising Carboxylic Acid Derivative."
PCT/CN2015/074033 English Translation of the Written Opinion dated May 29, 2015 entitled "Fire Extinguishing Composition Comprising Carboxylic Acid Derivative."
PCT/CN2015/074043 English Translation of the International Preliminary Report on Patentability dated Jul. 19, 2016 entitled "Fire Extinguishing Composition Comprising Heterocyclic Compounds."
PCT/CN2015/074043 English Translation of the International Search Report dated May 27, 2015 entitled "Fire Extinguishing Composition Comprising Heterocyclic Compounds."
PCT/CN2015/074043 English Translation of the Written Opinion dated May 27, 2015 entitled "Fire Extinguishing Composition Comprising Heterocyclic Compounds."
PCT/CN2015/074044 English Translation of the International Preliminary Report on Patentability dated Jul. 19, 2016 entitled "Fire Extinguishing Composition Comprising Aldoketones Compound."
PCT/CN2015/074044 English Translation of the International Search Report dated May 29, 2015 entitled "Fire Extinguishing Composition Comprising Aldoketones Compound."
PCT/CN2015/074044 English Translation of the Written Opinion dated May 29, 2015 entitled "Fire Extinguishing Composition Comprising Aldoketones Compound."
PCT/CN2015/074045 English Translation of the International Preliminary Report on Patentability dated Jul. 19, 2016 entitled "Fire Extinguishing Composition Comprising Alcohol Phenol Compound and Derivative Thereof."
PCT/CN2015/074045 English Translation of the International Search Report dated Jun. 17, 2015 entitled "Fire Extinguishing Composition Comprising Alcohol Phenol Compound and Derivative Thereof."
PCT/CN2015/074045 English Translation of the Written Opinion dated Jun. 17, 2015 entitled "Fire Extinguishing Composition Comprising Alcohol Phenol Compound and Derivative Thereof".

* cited by examiner

FIRE EXTINGUISHING COMPOSITION COMPRISING ALDOKETONES COMPOUND

RELATED APPLICATIONS

This application is the U.S. National Stage of International Application No. PCT/CN2015/074044, filed Mar. 11, 2015, which designates the U.S., published in Chinese, and claims priority under 35 U.S.C. §§ 119 or 365(c) to China (PRC) Application No. CN 201410014400.8, filed Jan. 13, 2014. The entire teachings of the above applications are incorporated herein by reference.

FIELD OF THE INVENTION

The present invention pertains to the technical field of aerosol fire distinguishing, particularly to a thermal aerosol fire-extinguishing composition.

BACKGROUND OF THE INVENTION

Since the specific target of each country for substitution of Halon fire extinguishing agents was put forth in Canadian Montreal Convention in 1987, all countries in the world have been committed to the research of new fire extinguishing techniques. Fire extinguishing techniques with high fire extinguishing efficiency and no environmental pollution are directions of our effort.

A gas fire extinguishing system, a powder extinguishing system, a water fire extinguishing system and the like are harmless to environment, so they are selected as substitutes of Halon fire extinguishing agents and are widely used. The fire extinguishing mechanism of the fire extinguishing systems of carbon dioxide, IG541 and inert gases mainly relies on physical fire extinguishing. The fire is put out by lowering the concentration of oxygen in the firing area. This fire extinguishing method would easily threaten human safety. The powder extinguishing system puts out a fire by spraying powder under the action of pressurized gas to contact flame and realize physical and chemical suppression effect. A water mist fire extinguishing system achieves the objects of controlling, suppressing and putting out a fire through triple actions of cooling, smothering, and isolation of thermal radiation by using water mist.

However, all these fire extinguishing systems need high pressure storage. Not only the volume is large but also there is a risk of physical explosion during storage. A document "Safety Analysis of Gas Fire Extinguishing System" (Fire Science and Technology 2002 21(5)) analyzes the risk of a gas fire extinguishing system and enumerates the safety accidents triggered by the stored pressure gas fire extinguishing system during use.

The existing thermal aerosol fire extinguishing agents are mainly type S and type K fire extinguishing agents. The comprehensive analysis of their performance and features indicates that their fire extinguishing mechanism is that the thermal aerosol fire extinguishing agents take a redox reaction through agent combustion to release a great quantity of gas and active particles and the goal of integrated chemical and physical fire extinguishing is realized through the chain scission reaction of the active particles and covering and smothering of a great quantity of gas. The disadvantage of the thermal aerosol fire extinguishing agents is that the thermal aerosol fire extinguishing agent will release a great quantity of heat while it takes the combustion reaction to release the thermal aerosol, which may cause a secondary combustion. In order to effectively reduce the temperature of the device and aerosol and avoid the secondary fire, a cooling system needs to be added. The cooling materials of the existing thermal aerosol fire extinguishing units can reduce the temperature of products, but they also greatly weaken the fire extinguishing performance of the products. In order to make up the loss on the fire extinguishing performance caused by the cooling system, many products either lower the fire extinguishing level or continuously increase the mass of the actual fire extinguishing agent, rendering the increase of product volume and the decrease of use efficiency, which results in a complex and cumbersome structure of the device, a complex technological process, a high cost, and a high nozzle temperature, which would easily cause injury to fire fighters.

SUMMARY OF THE INVENTION

Regarding the current situation of existing fire extinguishing devices, particularly the inherent defects of an aerosol fire extinguishing system, an object of the present invention is to provide a safer and more efficient fire-extinguishing composition.

The technical scheme of the present invention is:

A fire-extinguishing composition containing an aldehyde/ketone compound, wherein the fire-extinguishing composition contains an aldehyde/ketone compound; the fire-extinguishing composition releases a great quantity of active fire-extinguishing particles by making use of combustion of a pyrotechnic agent to put out a fire.

Further, the aldehyde/ketone fire-extinguishing composition comprises one or more of fatty aldehyde/ketone, aromatic aldehyde/ketone and alicyclic aldehyde/ketone compounds.

Further, the fatty aldehyde/ketone compound in the aldehyde/ketone fire-extinguishing composition comprises one or more of: paraformaldehyde, trichloracetic aldehyde, D(+)-xylose, zinc aetylacetonate, trans-undecadien-2-al, trifluoroacetaldehydeethylhemiacetal, 1,3-dihydroxypropanone, dimedone, copper acetylacetonate, 2-azabicyclo [2.2.1] hept-5-en-3-one, 4,4-trichloro-1-(2-naphthyl)-1,3-butanedione, 2-hydroxy-1,2-di (thiophen-2-yl) ethanone and acetoin.

Further, the aromatic aldehyde/ketone compound in the aldehyde/ketone fire-extinguishing composition comprises one or more of: 2,4-dichlorobenzaldehyde, benzophenone, ethoxybenzoin, vanillin, coumarin, anthraquinone, syringaldehyde, 4-hydroxy-3-nitrobenzaldehyde, 2,5-dihydroxybenzaldehyde, ethyl vanillin, 2,4,6-trimethoxybenzaldehyde, 3,5-dibenzyloxybenzaldehyde, 4-diethylaminobenzaldehyde, diphenylamino-4-benzaldehyde, 2-hydroxy-4-methoxybenzaldehyde, 3-bromo-5-chlorosalicylaldehyde, 2-cyanobenzaldehyde, 4-cyanobenzaldehyde, 3,5-dibromosalicylaldehyde, 3,5-di-tert-butylsalicylaldehyde, p-bromocinnamaldehyde, p-nitrocinnamaidehyde, 4-bromo-2-fluorobenzaldehyde, 3-carboxybenzaldehyde, cyclamen aldehyde, N—BOC-L-benzedrine aldehyde, 2-methoxybenzaldehyde, isovanillin, 4-bis (p-tolylamino) benzaldehyde, p-bromobenzaldehyde, p-chlorobenzaldehyd, 4-(dimethylamino) cinnamaldehyde, 4-(1-pyrrolidine) benzaldehyde, 4-trifluoromethoxybenzaldehyde, 2-amino-3,5-dibromobenzaldehyde, α-bromocinnamaldehyde, p-hydroxy benzaldehyde, 3,5-dichlorobenzaldehyde, 3,4,5-trimethoxybenzaldehyde, 2,5-dimethoxybenzaldehyde, o-methylbenzaldehyde, 3-bromo-4-hydroxybenzaldehyde, α-ionone2,4,5-trifluorobenzaldehyde, p-nitrobenzaldehyde, 4-benzyloxybenzaldehyde, anilinoacetaldehyde diethyl acetal, p-acetylaminobenzaldehyde, 1-methylindole-3-carbaldehyde, 4-hydroxy- 3-hydroxybenzaldehyde, 3,5-dichlorosalicylaldehyde, indanone, 4-chloroindanone, 5-chloroindanone, 5-bromo-1-indanone, 7-hydroxy-1-indanone, 5-hydroxy-1-indanone, 4-methoxy-1-indanone, 5-methoxy-1-indanone, 6-methoxy-1-indanone, 2,3-diphenyl-1-indenone, 4-carboxyl-9-indanone, 1,3-indandione, 2-hydroxy-4,6-dimethoxyacetophenone, 3,4,5-trimethoxyacetophenone, 4-hydroxy-3-methoxyacetophenone, 4-hydroxy-3-methoxyacetophenone, 2-chloro-4'-phenylacetophenone, 2,4,6-trihydroxyacetophenone, 2,6-trihydroxyacetophenone, 2-hydroxyacetophenone, 3-hydroxyacetophenone, 2,5-dihydroxyacetophenone, 4-methoxy-α-bromoacetophenone, 3-chloropropiophenone, 4-hydroxyacetophenone, 4'-iodoacetophenone, 4-2-chloroethylacetophenone, m-nitroacetophenone, 4-(methylthio) acetophenone, 3'-acetaminoacetophenone, p-aminoacetophenone, 2',4'-dihydroxy-2-phenylacetophenone, 4,4'-dimethylbenzophenone, 4,4'-dichlorobenzophenone, 4,4'-dibromobenzophenone, 4-chloro-4'-hydroxybenzophenone, 4,4'-diaminobenzophenone, para-aminobenzophenone, 2,3,4-trihydroxybenzophenone, 2,4-dihydroxybenzophenone, 2-amino-5-chloro-benzophenone, 2-amino-5-bromo-2'-fluorobenzophenone, 2-methoxy-5-chloro-benzophenone, 4-chloro-4'-hydroxybenzophenone, 3,4-difluorobenzophenone, 2-hydroxy-4-methoxy-5-sulfobenzophenone, 2-aminobenzophenone, p-aminopropiophenone, 9-thioxathone, 2-chlorothioxathone, 2-trifluoromethylthioxathone, xanthone, 3-hydroxy-9H-xanthen-9-one, 6-fluorochroman-4-one, acetosyringone, dibenzylideneacetone, 2-chloro-5-nitrobenzophenone, 1,2-benzisothiazolin-3-one, 2-methyl-4-isothiazolin-3-one, 6-amino-3,4-methylenedioxyacetophenone, 3-benzofuranone, 6-chlorochroman-4-one, 5-fluorooxindole, N-acetyloxindole, N-methyloxindole, 3',4'-(methylenedioxy) acetophenone, 9-fluorenone, 2-bromo-9-fluorenone, 2-hydroxy-5-nitroacetophenone, 2,7-dibromofluorenone, 2-indolone, 4-nitrobenzophenone, 2-benzoxazolone, 5-hydroxy-1-tetralone, 2-bromo-2'-acetonaphthone, biphenyl methyl ketone, tetraphenylcyclopentadienone, 2,2',4,4'-tetrahydroxybenzophenone, benzotetrahydropyridine-2,4-dione, 5-hydroxy-1-tetralone, 4-benzyl-2-oxazolidinone, 7-methoxy-3(2H)-benzofuranone, dibenzoylmethane, 2-amino-5-nitrobenzophenone, 1-triphenylphosphine-2-propanone, 3-(diethoxyphosphoryloxy)-1,2,3-phentriazine-4-one, 7-hydroxy-3,4-dihydro-2(1H)-quinolinone, 4-methylumbelliferone, benzoylnitromethane, genistein, 4,6,7-trihydroxyisoflavone, tanshinone IIA, 4-tert-butyl-4'-methoxydibenzoylmethane, triphenylacetophenone, myricetin, rutin, hesperidin, baicalin, naringin, grape seed OPC, citrus flavonoids, rheum emodin, tribulus terrestris total saponins, hawthorn total flavonoids, puerarin and soyasaponin.

Further, the alicyclic aldehyde/ketone compound in the aldehyde/ketone fire-extinguishing composition includes one or more of: aminopyrine, antipyrine, caprolactam, succinimide, 1-phenyl-3-methyl-5-pyrazolone, polyvinylpyrrolidone K30, camphor, allantoin, cyclohexanone oxime, 6-bromo-2-pyridinecarboxaldehyde, phosphopyridoxal, 6-methyl-2-pyridinecarboxaldehyde, ferrocenecarboxaldehyde, 3-isopropyl-2,5-piperazinedione, 6-methoxy-3-pyridinecarboxaldehyde, 5-bromo-3-pyridinecarboxaldehyde, 2-chloro-3-pyridinecarboxaldehyde, 2-amino-4,6-dichloropyrimidine-5-carbaldehyde, 3-(2-furyl) propenal, thiophene-2,3-dicarbaldehyde, 2,6-dichloro-3-pyridinecarboxaldehyde, triplal, evertal, isocyclocitral (2,4,6-trimethyl-3-cyclohexene-carboxaldehyde), myrac aldehyde, lyral, 2-amino-3-pyridinecarboxaldehyde, 5-bromo-2-furfural, aldosterone, 2-adamantanone, 2,5-dimethyl-3-(2H) furanone, 6-hydroxy-3,4-dihydro-quinolinone, methyl cyclopentenolone, 3,5-dimethylcyclopentenolone, 4-aminobenzyl-1,3-oxazolidine-2-one, 4-phenyl-2-oxazolidinone, 3-pyridazinone, progesterone, 4-hydroxy-2-pyrrolidone, 2,6-dimethyl-γ-pyrone, 4-hydroxy-6-methyl-2-pyrone, cross-linked polyvinylpyrrolidone, 5-hydroxymethyl-2-pyrrolidone, 1,3-cyclohexanedione, bispyrazolone, 4-isopropyl-2-oxazolidinone, 1,3-dimethyl-5-pyrazolone, tolperisone hydrochloride, tetraphenylcyclopentadienone, 4-trifluoroacetyl-3-methyl-1-phenyl-5-pyrazolone, 1-acetyl-2-pyrrolidone, 1,2,4-triazolo [4,3-a] pyridin-3 (2H)-one, dihydro-3-(tetradecenyl) furan-2,5-dione, 2,4,4,6-tetrabromo-2,5-cyclohexadiene, 4-(4-hydroxyphenyl) cyclohexanone, 1-(2-chloro-5-sulfophenyl)-3-methyl-5-pyrazolone, 1-(4-sulfophenyl)-3-methyl-5-pyrazolone, 1-(4-chlorophenyl)-3-methyl-5-pyrazolone, D-gluconic acid-γ-lactone acetonide compound, 2,4-thiazolidinedione, 1,4-cyclohexanedione monoethylene acetal, tetrafluorohydroquinone, 4-acetoxyazetidion, 4-N-acetylamino-cyclohexanon, 1-phenyl-1,3,8-triazaspiro[4,5]decan-4-one, a copolymer of vinyl acetate and N-vinyl pyrrolidone, testosteronedecanoate, dehydroepiandrosterone, androsterone, testosterone phenylpropionate and dehydroepiandrosterone acetate and stanolone.

Further, the fire-extinguishing composition comprises an auxiliary fire-extinguishing material.

Further, the auxiliary fire-extinguishing material comprises: brominated flame retardants, chlorinated flame retardants, organophosphorus flame retardants, phosphorus-halogen flame retardants, nitrogen flame retardants, phosphorus-nitrogen flame retardants, inorganic flame retardants or any of their combinations.

Further, the fire-extinguishing composition comprises an additive and the content of the additive is 0.1-10%.

Further, the additive is a mold release agent, adhesive, catalyst or additive with other performances, such as: one or more of stearate, graphite, sodium silicate, phenolic resin, shellac, starch, dextrin, rubber, epoxy resin, acetal adhesive and hydroxypropyl methyl cellulose.

In addition to the substances listed above, all other organic or inorganic substances that can realize the foregoing functions may be used as substitutes of additives in the fire-extinguishing composition of the present invention.

Further, the components of the fire-extinguishing composition and their mass percentages preferably are:

| | |
|---|---|
| the aldehyde/ketone compound | 35%-90% |
| the auxiliary fire-extinguishing material | 10%-60% |
| the additive | 1%-10%. |

Further, the components of the fire-extinguishing composition and their mass percentages preferably are:

| | |
|---|---|
| the aldehyde/ketone compound | 49%-85% |
| the auxiliary fire-extinguishing material | 14%-50% |
| the additive | 1%-5%. |

The fire-extinguishing composition of the present invention adopts the following flame suppression mechanism:

During use, the pyrotechnic agent is used as a source of heat and a source of power. The heat released from ignition and combustion of the pyrotechnic agent makes the aldehyde/ketone compound react at a high temperature to generate free radical alkyl (or aryl), free radical acyl, free radical carbonyl, and other active fire-extinguishing particles. These active fire-extinguishing particles react with one or more of O-, OH-, H-free radicals necessary for the chain combustion reaction, thereby cutting off the chain combustion reaction. Meanwhile, they take a synergistic interaction effect with the pyrotechnic agent to further raise the fire extinguishing efficiency of the fire extinguishing agent and greatly shorten the effective fire extinguishing time.

As compared with the existing thermal aerosol fire extinguishing agents, the fire-extinguishing composition of the present invention has the following advantages:

1. The aldehyde/ketone compound in the fire-extinguishing composition of the present invention reacts at a high temperature to generate various kinds of free radicals that can effectively put out a fire, to cut off the combustion reaction chain, and work together with the reaction products of the thermal aerosol generating agent to jointly play a fire extinguishing effect, further raise the fire extinguishing efficiency of the fire extinguishing agent and shorten the effective fire extinguishing time.
2. The fire-extinguishing composition of the present invention makes use of the heat generated from the combustion of the aerosol generating agent to take the endothermic reaction fast, thereby absorbing the heat released from the combustion of the pyrotechnic agent and reducing the temperature at a nozzle of the fire extinguishing device. Therefore, the fire-extinguishing composition is safer, would not do harm to fire fighters and also avoids secondary fires.
3. An aerosol fire extinguishing device adopting the fire-extinguishing composition of the present invention does not need a cooling system with a complex structure and a large volume, so it has the characteristics of a handy structure, a simple technological process and good economy.

DETAILED DESCRIPTION OF THE EMBODIMENTS

Below are embodiments of the present invention for illustrating a technical scheme for solving the technical problems in this application document and helping those skilled in the art understand the content of the present invention, however, the realization of the technical scheme of the present invention is not limited to these embodiments.

Take the fire-extinguishing composition of the present invention in proportion, add a specific amount of additive as required, use water as a solvent, pelletize by using a 20-mesh sieve, then add a specific amount of the mold release agent, and after mixing the same, the mixture is sieved by a 15-mesh sieve, and molded into a shape of ball, slice, strip, block or honeycomb through adopting pelleting, mould pressing, extruding or other processes; add 50 g of the mixture to a fire extinguishing device filled with 50 g of a type K aerosol generating agent, and a fire extinguishing experiment is performed according to a fire extinguishing experiment model.

Comparative Example 1

Use a fire extinguishing device sample containing 50 g of a K salt type aerosol fire extinguishing agent and perform a fire extinguishing experiment according to the fire extinguishing experiment model.

Comparative Example 2

Use a fire extinguishing device sample containing 50 g of a type S aerosol fire extinguishing agent and perform a fire extinguishing experiment according to the fire extinguishing experiment model.

The fire extinguishing experiment model is an oil tray fire extinguishing experiment:

Experimental model: The oil tray is a round tray as mentioned in GA86-2009 8B (diameter: 570 mm; internal depth: 150 mm; approximate area: 0.25 $m^2$).

Experimental method: Add 50 mm of water in the oil tray, add 22 mm of 93# motor gasoline, pre-burn for 1 min and then start fire extinguishing.

Evaluation standard: If no reburning takes place 1 min after the flame is put out and there is gasoline remaining in the oil tray, it is considered that fire extinguishing is successful. Experiment is performed for three times for each formula. Fire extinguishing effects, fire extinguishing time and nozzle temperatures are recorded. The experimental results are shown in Tables 1-6:

TABLE 1

Comparison of various components and ingredients and comparison of fire extinguishing test results thereof

| | Comparative example 1 | | | | | Comparative | |
|---|---|---|---|---|---|---|---|
| Component | 1 | 2 | 3 | 4 | 5 | example 2 | |
| Commercial type K aerosol | | | | | | ● | |
| Commercial type S aerosol | | | | | | | ● |
| Paraformaldehyde $(CH_2O)n$ | 92 | | | | | | |
| Trichloracetic aldehyde $CCl_3CHO$ | | 93 | | | | | |
| D(+)-xylose $C_4H_9O_4CHO$ | | | 94 | | | | |
| Zinc aetylacetonate $C_{10}H_{14}ZnO_4$ | | | | 95 | | | |
| Dimedone $C_8H_{12}O_2$ | | | | | 96 | | |
| Magnesium stearate | 2 | 2 | 2 | 2 | 2 | | |
| Hydroxypropyl methyl cellulose | 6 | 5 | 4 | 3 | 2 | | |
| Nozzle temperature ° C. | 863 | 785 | 697 | 786 | 805 | 1254 | 1362 |
| Fire extinguishing performance | 2 Extinctions out of 3 | 2 Extinctions out of 3 | 2 Extinctions out of 3 | Full Extinctions | 2 Extinctions out of 3 | No Extinctions | No Extinctions |
| Fire extinguishing time s | 6 | 7 | 4 | 5 | 8 | | |

TABLE 2

Comparison of various components and ingredients and comparison of fire extinguishing test results thereof

| Component | Comparative example 1 | | | | | Comparative example 2 | |
|---|---|---|---|---|---|---|---|
| | 6 | 7 | 8 | 9 | 10 | | |
| Commercial type K aerosol | | | | | | ● | |
| Commercial type S aerosol | | | | | | | ● |
| Ethoxybenzoin $C_{18}H_{22}O_3$ | 92 | | | | | | |
| Benzophenone $C_{13}H_{10}O$ | | 93 | 40 | | | | |
| Vanillin $C_8H_8O_3$ | | | 54 | | | | |
| Coumarin $C_9H_6O_2$ | | | | 95 | | | |
| Anthraquinone $C_{14}H_8O_2$ | | | | | 96 | | |
| Magnesium stearate | 2 | 2 | 2 | 2 | 2 | | |
| Hydroxypropyl methyl cellulose | 6 | 5 | 4 | 3 | 2 | | |
| Nozzle temperature ° C. | 834 | 789 | 756 | 797 | 843 | 1275 | 1316 |
| Fire extinguishing performance | 2 Extinctions out of 3 | 2 Extinctions out of 3 | Full Extinctions | Full Extinctions | 2 Extinctions out of 3 | No Extinctions | No Extinctions |
| Fire extinguishing time s | 8 | 6 | 5 | 5 | 8 | | |

TABLE 3

Comparison of various components and ingredients and comparison of fire extinguishing test results thereof

| Component | Comparative example 1 | | | | | Comparative example 2 | |
|---|---|---|---|---|---|---|---|
| | 11 | 12 | 13 | 14 | 15 | | |
| Commercial type K aerosol | | | | | | ● | |
| Commercial type S aerosol | | | | | | | ● |
| Aminopyrine $C_{13}H_{17}N_3O$ | 66 | | | | | | |
| Antipyrine $C_{11}H_{12}N_2O$ | | 93 | | | | | |
| Allantoin $C_4H_6O_3N_4$ | | | 94 | | | | |
| Camphor $C_{10}H_{16}O$ | 26 | | | 95 | | | |
| Caprolactam $C_6H_{11}NO$ | | | | | 96 | | |
| Magnesium stearate | 2 | 2 | 2 | 2 | 2 | | |
| Hydroxypropyl methyl cellulose | 6 | 5 | 4 | 3 | 2 | | |
| Nozzle temperature ° C. | 774 | 759 | 735 | 814 | 823 | 1198 | 1387 |
| Fire extinguishing performance | 2 Extinctions out of 3 | 2 Extinctions out of 3 | 2 Extinctions out of 3 | Full Extinctions | 2 Extinctions out of 3 | No Extinctions | No Extinctions |
| Fire extinguishing time s | 7 | 8 | 5 | 6 | 8 | | |

TABLE 4

Comparison of various components and ingredients and comparison of fire extinguishing test results thereof

| Component | Comparative example 1 | | | | | Comparative example 2 | |
|---|---|---|---|---|---|---|---|
| | 16 | 17 | 18 | 19 | 20 | | |
| Commercial type K aerosol | | | | | | ● | |
| Commercial type S aerosol | | | | | | | ● |
| Paraformaldehyde $(CH_2O)n$ | 55 | | | | | | |
| Trichloracetic aldehyde $CCl_3CHO$ | | 65 | | | | | |
| D(+)-xylose $C_4H_9O_4CHO$ | | | 73 | | | | |
| Zinc aetylacetonate $C_{10}H_{14}ZnO_4$ | | | | 80 | | | |
| Dimedone $C_8H_{12}O_2$ | | | | | 85 | | |
| Ammonium tetrafluoroborate | 30 | | | | | | |
| Melamine | | 18 | | 8 | | | |
| Aluminum hydroxide | | | 13 | 8 | | | |
| Monopotassium phosphate | | 12 | | | | | |
| Sodium bicarbonate | 10 | | | | 7 | | |
| Dicyandiamide | | | 10 | | 7 | | |
| Magnesium stearate | 2 | 1 | 2 | 2 | 0.5 | | |
| Hydroxypropyl methyl cellulose | 3 | 2 | 2 | 2 | 0.5 | | |
| Nozzle temperature ° C. | 765 | 794 | 735 | 813 | 834 | 1134 | 1329 |
| Fire extinguishing performance | 2 Extinctions out of 3 | 2 Extinctions out of 3 | Full Extinctions | Full Extinctions | 2 Extinctions out of 3 | No Extinctions | No Extinctions |
| Fire extinguishing time s | 6 | 7 | 5 | 6 | 8 | | |

TABLE 5

Comparison of various components and ingredients and comparison of fire extinguishing test results thereof

| Component | Comparative example 1 | | | | | Comparative example 2 | |
|---|---|---|---|---|---|---|---|
| | 21 | 22 | 23 | 24 | 25 | | |
| Commercial type K aerosol | | | | | | ● | |
| Commercial type S aerosol | | | | | | | ● |
| Ethoxybenzoin $C_{18}H_{22}O_3$ | 55 | | | | 40 | | |
| Benzophenone $C_{13}H_{10}O$ | | 66 | | | | | |
| Vanillin $C_8H_8O_3$ | | | 73 | | | | |
| Coumarin $C_9H_6O_2$ | | | | 80 | | | |
| Anthraquinone $C_{14}H_8O_2$ | | | | | 45 | | |
| Ammonium tetrafluoroborate | | | | | | | |
| Melamine | | 24 | | 6 | | | |
| Aluminum hydroxide | | | 10 | | 9 | | |
| Monopotassium phosphate | 28 | | | 8 | | | |
| Sodium bicarbonate | | 15 | 16 | | | | |
| Dicyandiamide | 12 | | | | | | |
| Magnesium stearate | 2 | 2 | 0.5 | 3 | 4 | | |
| Hydroxypropyl methyl cellulose | 3 | 3 | 0.5 | 3 | 2 | | |
| Nozzle temperature ° C. | 836 | 812 | 765 | 783 | 772 | 1184 | 1352 |
| Fire extinguishing performance | All | 2 Extinctions out of 3 | 2 Extinctions out of 3 | Full Extinctions | 2 Extinctions out of 3 | No Extinctions | No Extinctions |
| Fire extinguishing time s | 7 | 4 | 6 | 4 | 6 | | |

TABLE 6

Comparison of various components and ingredients and comparison of fire extinguishing test results thereof

| Component | Comparative example 1 | | | | | Comparative example 2 | |
|---|---|---|---|---|---|---|---|
| | 26 | 27 | 28 | 29 | 30 | | |
| Commercial type K aerosol | | | | | | ● | |
| Commercial type S aerosol | | | | | | | ● |
| Aminopyrine $C_{13}H_{17}N_3O$ | 45 | | | | | | |
| Antipyrine $C_{11}H_{12}N_2O$ | | 63 | | | | | |
| Allantoin $C_4H_6O_3N_4$ | | | 70 | | | | |
| Camphor $C_{10}H_{16}O$ | | | | 78 | | | |
| Caprolactam $C_6H_{11}NO$ | 10 | | | | 85 | | |
| Ammonium tetrafluoroborate | 25 | | | | | | |
| Melamine | 15 | | | 18 | | | |
| Aluminum hydroxide | | | 12 | | | | |
| Monopotassium phosphate | | | | | 14 | | |
| Sodium bicarbonate | | 15 | 14 | | | | |
| Dicyandiamide | | 20 | | | | | |
| Magnesium stearate | 2 | 1 | 2 | 2 | 0.5 | | |
| Hydroxypropyl methyl cellulose | 3 | 1 | 2 | 2 | 0.5 | | |
| Nozzle temperature ° C. | 786 | 769 | 738 | 786 | 816 | 1208 | 1327 |
| Fire extinguishing performance | Full Extinctions | 2 Extinctions out of 3 | 2 Extinctions out of 3 | Full Extinctions | 2 Extinctions out of 3 | No Extinctions | No Extinctions |
| Fire extinguishing time s | 8 | 6 | 5 | 5 | 8 | | |

The foregoing embodiments are merely explanations to the preferred schemes of the present invention, and are not the limitation to the present invention. All changes and modifications to the foregoing embodiments within the essential spirit scope of the present invention should fall within the scope of protection of the claims of the present application.

What is claimed is:

1. A fire-extinguishing composition comprising:

i) 35%-90% by mass of one or more of a compound selected from the group consisting of:

trichloracetic aldehyde, D(+)-xylose, zinc acetylacetonate, trans-undecadien-2-al, trifluoroacetaldehydeethylhemiacetal, 1,3-dihydroxypropanone, dimedone, copper acetylacetonate, 2-azabicyclo [2.2.1] hept-5-en-3-one, 4,4-trichloro-1-(2-naphthyl)-1,3-butanedione, 2-hydroxy-1,2-di (thiophen-2-yl) ethanone, acetoin, 2,4-dichlorobenzaldehyde, benzophenone, ethoxybenzoin, vanillin, coumarin, anthraquinone, syringaldehyde, 4-hydroxy-3-nitrobenzaldehyde, 2,5-dihydroxybenzaldehyde, ethyl vanillin, 2,4,6-trimethoxybenzaldehyde, 3,5-dibenzyloxybenzaldehyde, 4-diethylaminobenzaldehyde, diphenylamino-4-benzaldehyde, 2-hydroxy-4-methoxybenzaldehyde, 3-bromo-5-chlorosalicylaldehyde, 2-cyanobenzaldehyde, 4-cyanobenzaldehyde, 3,5-dibromosalicylaldehyde, 3,5-di-tert-butylsalicylaldehyde, p-bromocinnamaldehyde, p-nitrocinnamaldehyde, 4-bromo-2-fluorobenzaldehyde, 3-carboxybenzaldehyde, cyclamen aldehyde, N-BOC-L-benzedrine aldehyde, 2-methoxybenzaldehyde, isovanillin, 4-bis (p-tolylamino) benzaldehyde, p-bromobenzaldehyde, p-chlorobenzaldehyde, 4-(dimethylamino) cinnamaldehyde, 4-(1-pyrrolidine) benzaldehyde, 4-trifluoromethoxybenzaldehyde, 2-amino-3,5-dibromobenzaldehyde, a-bromocinnamaldehyde, p-hydroxy benzaldehyde, 3,5-dichlorobenzaldehyde, 3,4,5-trimethoxybenzaldehyde, 2,5-dimethoxybenzaldehyde, o-methylbenzaldehyde, 3-bromo-4-hydroxybenzaldehyde, a-ionone, 2,4,5-trifluorobenzaldehyde, p-nitrobenzaldehyde, 4-benzyloxybenzaldehyde, anilinoacetaldehyde diethyl acetal, p-acetylaminobenzaldehyde, 1-methylindole-3-carbaldehyde, 4-hydroxy-3-hydroxybenzaldehyde, 3,5-dichlorosalicylaldehyde, indanone, 4-chloroindanone, 5-chloroindanone, 5-bromo-1-indanone, 7-hydroxy-1-indanone, 5-hydroxy-1-indanone, 4-methoxy-1-indanone, 5-methoxy-1-indanone, 6-methoxy-1-indanone, 2,3-diphenyl-1-indenone, 4-carboxyl-9-indanone, 1,3-indandione, 2-hydroxy-4,6-dimethoxyacetophenone, 3,4,5-trimethoxyacetophenone, 4-hydroxy-3-methoxyacetophenone, 4-hydroxy-3-methoxyacetophenone, 2-chloro-4'-phenylacetophenone, 2,4,6-trihydroxyacetophenone, 2,6-dihydroxyacetophenone, 2-hydroxyacetophenone, 3-hydroxyacetophenone, 2,5-dihydroxyacetophenone, 4-methoxy-α-bromoacetophenone, 3-chloropropiophenone, 4-hydroxyacetophenone, 4'-iodoacetophenone, 4-2-chloroethylacetophenone, m-nitroacetophenone, 4-(methylthio) acetophenone, 3'-acetaminoacetophenone, p-aminoacetophenone, 2',4'-dihydroxy-2-phenylacetophenone, 4,4'-dimethylbenzophenone, 4,4'-dichlorobenzophenone, 4,4'-dibromobenzophenone, 4-chloro-4'-hydroxybenzophenone, 4,4'-diaminobenzophenone, para-aminobenzophenone, 2,3,4-trihydroxybenzophenone, 2,4-dihydroxybenzophenone, 2-amino-5-chloro-benzophenone, 2-amino-5-bromo-2'-fluorobenzophenone, 2-methoxy-5-chloro-benzophenone, 4-chloro-4'-hydroxybenzophenone, 3,4-difluorobenzophenone, 2-hydroxy-4-methoxy-5-sulfobenzophenone, 2-aminobenzophenone, p-aminopropiophenone, 9-thioxathone, 2-chlorothioxathone, 2-trifluoromethylthioxathone, xanthone, 3-hydroxy-9H-xanthen-9-one, 6-fluorochroman-4-one, acetosyringone, dibenzylideneacetone, 2-chloro-5-nitrobenzophenone, 1,2-benzisothiazolin-3-one, 2-methyl-4-isothiazolin-3-one, 6-amino-3,4-methylenedioxyacetophenone, 3-benzofuranone, 6-chlorochroman-4-one, 5-fluorooxindole, N-acetyloxindole, N-methyloxindole, 3',4'-(methylenedioxy) acetophenone, 9-fluorenone, 2-bromo-9-fluorenone, 2-hydroxy-5-nitroacetophenone, 2,7-dibromofluorenone, 2-indolone, 4-nitrobenzophenone, 2-benzoxazolone, 5-hydroxy-1-tetralone, 2-bromo-2'-acetonaphthone, biphenyl methyl ketone, tetraphenylcyclopentadienone, 2,2',4,4'-tetrahydroxybenzophenone, benzotetrahydropyridine-2,4-dione, 4 benzyl-2-oxazolidinone, 7-methoxy-3 (2H)-benzofuranone, dibenzoylmethane, 2-amino-5-nitrobenzophenone, 1-triphenylphosphine-2-propanone, 3-(diethoxyphosphoryloxy)-1,2,3-phentriazine-4-one, 7-hydroxy-3,4-dihydro-2(1H)-quinolinone, 4-methylumbelliferone, benzoylnitromethane, genistein, 4,6,7-trihydroxyisoflavone, tanshinone IIA, 4-tert-butyl-4'-methoxydibenzoylmethane, triphenylacetophenone, myricetin, rutin, hesperidin, baicalin, naringin, rheum emodin, puerarin, soyasaponin, aminopyrine, antipyrine, caprolactam, succinimide, 1-phenyl-3-methyl-5-pyrazolone, polyvinylpyrrolidone K30, camphor, allantoin, cyclohexanone oxime, 6-bromo-2-pyridinecarboxaldehyde, phosphopyridoxal, 6-methyl-2-pyridinecarboxaldehyde, 3-isopropyl-2,5-piperazinedione, 6-methoxy-3-pyridinecarboxaldehyde, 5-bromo-3-pyridinecarboxaldehyde, 2-chloro-3-pyridinecarboxaldehyde, 2-amino-4,6-dichloropyrimidine-5-carbaldehyde, 3-(2-furyl) propenal, thiophene-2,3-dicarbaldehyde, 2,6-dichloro-3-pyridinecarboxaldehyde, 2,4,6-trimethyl-3-cyclohexene-carboxaldehyde, myrac aldehyde, 2-amino-3-pyridinecarboxaldehyde, 5-bromo-2-furfural, aldosterone, 2-adamantanone, 2,5-dimethyl-3-(2H) furanone, 6-hydroxy-3,4-dihydro-quinolinone, methyl cyclopentenolone, 3,5-dimethylcyclopentenolone, 4-aminobenzyl-1,3-oxazolidine-2-one, 4-phenyl-2-oxazolidinone, 3-pyridazinone, progesterone, 4-hydroxy-2-pyrrolidone, 2,6-dimethyl-γ-pyrone, 4-hydroxy-6-methyl-2-pyrone, cross-linked polyvinylpyrrolidone, 5-hydroxymethyl-2-pyrrolidone, 1,3-cyclohexanedione, bispyrazolone, 4-isopropyl-2-oxazolidinone, 1,3-dimethyl-5-pyrazolone, tolperisone hydrochloride, 4 trifluoroacetyl-3-methyl-1-phenyl-5-pyrazolone, 1-acetyl-2-pyrrolidone, 1,2,4-triazolo [4,3-a] pyridin-3(2H)-one, dihydro-3-(tetradecenyl) furan-2,5-dione, 2,4,4,6-tetrabromo-2,5-cyclohexadiene, 4-(4-hydroxyphenyl) cyclohexanone, 1-(2-chloro-5-sulfophenyl)-3-methyl-5-pyrazolone, 1-(4-sulfophenyl)-3-methyl-5-pyrazolone, 1-(4-chlorophenyl)-3-methyl-5-pyrazolone, D-gluconic acid-γ-lactone acetonide, 2,4-thiazolidinedione, 1,4-cyclohexanedione monoethylene acetal, tetrafluorohydroquinone, 4-acetoxyazetidion, 4-N-acetyl-amino-cyclohexanon, 1-phenyl-1,3,8-triazaspiro [4,5] decan-4-one, a copolymer of vinyl acetate and N-vinyl pyrrolidone, testosteronedecanoate, dehydroepiandrosterone, androsterone, testosterone phenylpropionate, dehydroepiandrosterone acetate, and stanolone;

ii) 10%-60% by mass of an auxiliary fire-extinguishing material; and ii) 1%-10% by mass of an additive.

2. The fire-extinguishing composition according to claim 1, wherein i) is 35%-90% by mass of one or more of a compound selected from the group consisting of: trichloracetic aldehyde, D(+)-xylose, zinc acetylacetonate, trans-undecadien-2-al, trifluoroacetaldehydeethylhemiacetal, 1,3-dihydroxypropanone, dimedone, copper acetylacetonate, 2-azabicyclo [2.2.1] hept-5-en-3-one, 4,4-trichloro-1-(2-naphthyl)-1,3-butanedione, 2-hydroxy-1,2-di (thiophen-2-yl) ethanone and acetoin.

3. The fire-extinguishing composition according to claim 1, wherein i) is 35%-90% by mass of one or more of a compound selected from the group consisting of: 2,4-dichlorobenzaldehyde, benzophenone, ethoxybenzoin, vanillin, coumarin, anthraquinone, syringaldehyde, 4-hydroxy-3-nitrobenzaldehyde, 2,5-dihydroxybenzaldehyde, ethyl vanillin, 2,4,6-trimethoxybenzaldehyde, 3,5-dibenzyloxybenzaldehyde, 4-diethylaminobenzaldehyde, diphenylamino-4-benzaldehyde, 2-hydroxy-4-methoxybenzaldehyde, 3-bromo-5-chlorosalicylaldehyde, 2-cyanobenzaldehyde, 4-cyanobenzaldehyde, 3,5-dibromosalicylaldehyde, 3,5-di-tert-butylsalicylaldehyde, p-bromocinnamaldehyde, p-nitrocinnamaldehyde, 4-bromo-2-fluorobenzaldehyde, 3-carboxybenzaldehyde, cyclamen aldehyde, N-BOC-L-benzedrine aldehyde, 2-methoxybenzaldehyde, isovanillin, 4-bis (p-tolylamino) benzaldehyde, p-bromobenzaldehyde, p-chlorobenzaldehyd, 4-(dimethylamino) cinnamaldehyde, 4-(1-pyrrolidine) benzaldehyde, 4-trifluoromethoxybenzaldehyde, 2-amino-3,5-dibromobenzaldehyde, α-bromocinnamaldehyde, p-hydroxy benzaldehyde, 3,5-dichlorobenzaldehyde, 3,4,5-trimethoxybenzaldehyde, 2,5-dimethoxybenzaldehyde, o-methylbenzaldehyde, 3-bromo-4-hydroxybenzaldehyde, α-ionone, 2,4,5-trifluorobenzaldehyde, p-nitrobenzaldehyde, 4-benzyloxybenzaldehyde, anilinoacetaldehyde diethyl acetal, p-acetylaminobenzaldehyde, 1-methylindole-3-carbaldehyde, 4-hydroxy-3-hydroxybenzaldehyde, 3,5-dichlorosalicylaldehyde, indanone, 4-chloroindanone, 5-chloroindanone, 5-bromo-1-indanone, 7-hydroxy-1-indanone, 5-hydroxy-1-indanone, 4-methoxy-1-indanone, 5-methoxy-1-indanone, 6-methoxy-1-indanone, 2,3-diphenyl-1-indenone, 4-carboxyl-9-indanone, 1,3-indandione, 2-hydroxy-4,6-dimethoxyacetophenone, 3,4,5-trimethoxyacetophenone, 4-hydroxy-3-methoxyacetophenone, 4-hydroxy-3-methoxyacetophenone, 2-chloro-4'-phenylacetophenone, 2,4,6-trihydroxyacetophenone, 2,6-dihydroxyacetophenone, 2-hydroxyacetophenone, 3-hydroxyacetophenone, 2,5-dihydroxyacetophenone, 4-methoxy-a-bromoacetophenone, 3-chloropropiophenone, 4-hydroxyacetophenone, 4'-iodoacetophenone, 4-2-chloroethylacetophenone, m-nitroacetophenone, 4-(methylthio) acetophenone, 3'-acetaminoacetophenone, p-aminoacetophenone, 2',4'-dihydroxy-2-phenylacetophenone, 4,4'-dimethylbenzophenone, 4,4'-dichlorobenzophenone, 4,4'-dibromobenzophenone, 4-chloro-4'-hydroxybenzophenone, 4,4'-diaminobenzophenone, para-aminobenzophenone, 2,3,4-trihydroxybenzophenone, 2,4-dihydroxybenzophenone, 2-amino-5-chloro-benzophenone, 2-amino-5-bromo-2'-fluorobenzophenone, 2-methoxy-5-chloro-benzophenone, 4-chloro-4'-hydroxybenzophenone, 3,4-difluorobenzophenone, 2-hydroxy-4-methoxy-5-sulfobenzophenone, 2-aminobenzophenone, p-aminopropiophenone, 9-thioxathone, 2-chlorothioxathone, 2-trifluoromethylthioxathone, xanthone, 3-hydroxy-9H-xanthen-9-one, 6-fluorochroman-4-one, acetosyringone, dibenzylideneacetone, 2-chloro-5-nitrobenzophenone, 1,2-benzisothiazolin-3-one, 2-methyl-4-isothiazolin-3-one, 6-amino-3,4-methylenedioxyacetophenone, 3-benzofuranone, 6-chlorochroman-4-one, 5-fluorooxindole, N-acetyloxindole, N-methyloxindole, 3',4'-(methylenedioxy) acetophenone, 9-fluorenone, 2-bromo-9-fluorenone, 2-hydroxy-5-nitroacetophenone, 2,7-dibromofluorenone, 2-indolone, 4-nitrobenzophenone, 2-benzoxazolone, 5-hydroxy-1-tetralone, 2-bromo-2'-acetonaphthone, biphenyl methyl ketone, tetraphenylcyclopentadienone, 2,2',4,4'-tetrahydroxybenzophenone, benzotetrahydropyridine-2,4-dione, 4-benzyl-2-oxazolidinone, 7-methoxy-3 (2H)-benzofuranone, dibenzoylmethane, 2-amino-5-nitrobenzophenone, 1-triphenylphosphine-2-propanone, 3-(diethoxyphosphoryloxy)-1,2,3-phentriazine-4-one, 7-hydroxy-3,4-dihydro-2 (1H)-quinolinone, 4-methylumbelliferone, benzoylnitromethane, genistein, 4,6,7-trihydroxyisoflavone, tanshinone IIA, 4-tert-butyl-4'-methoxydibenzoylmethane, triphenylacetophenone, myricetin, rutin, hesperidin, baicalin, naringin, rheum emodin, puerarin and soyasaponin.

4. The fire-extinguishing composition according to claim 1, which comprises i) 35%-90% by mass of one or more of aminopyrine, antipyrine, caprolactam, succinimide, 1-phenyl-3-methyl-5-pyrazolone, polyvinylpyrrolidone K30, camphor, allantoin, cyclohexanone oxime, 6-bromo-2-pyridinecarboxaldehyde, phosphopyridoxal, 6-methyl-2-pyridinecarboxaldehyde, 3-isopropyl-2,5-piperazinedione, 6-methoxy-3-pyridinecarboxaldehyde, 5-bromo-3-pyridinecarboxaldehyde, 2-chloro-3-pyridinecarboxaldehyde, 2-amino-4,6-dichloropyrimidine-5-carbaldehyde, 3-(2-furyl) propenal, thiophene-2,3-dicarbaldehyde, 2,6-dichloro-3-pyridinecarboxaldehyde, 2,4,6-trimethyl-3-cyclohexenecarboxaldehyde, myrac aldehyde, 2 amino-3-pyridinecarboxaldehyde, 5-bromo-2-furfural, aldosterone, 2-adamantanone, 2,5-dimethyl-3-(2H) furanone, 6-hydroxy-3,4-dihydro-quinolinone, methyl cyclopentenolone, 3,5-dimethylcyclopentenolone, 4-aminobenzyl-1,3-oxazolidine-2-one, 4-phenyl-2-oxazolidinone, 3-pyridazinone, progesterone, 4-hydroxy-2-pyrrolidone, 2,6-dimethyl-γ-pyrone, 4-hydroxy-6-methyl-2-pyrone, cross-linked polyvinylpyrrolidone, 5-hydroxymethyl-2-pyrrolidone, 1,3-cyclohexanedione, bispyrazolone, 4-isopropyl-2-oxazolidinone, 1,3-dimethyl-5-pyrazolone, tolperisone hydrochloride, tetraphenylcyclopentadienone, 4-trifluoroacetyl-3-methyl-1-phenyl-5-pyrazolone, 1-acetyl-2-pyrrolidone, 1,2,4-triazolo [4,3-a] pyridin-3(2H)-one, dihydro-3-(tetradecenyl) furan-2,5-dione, 2,4,4,6-tetrabromo-2,5-cyclohexadiene, 4-(4-hydroxyphenyl) cyclohexanone, 1-(2-chloro-5-sulfophenyl)-3-methyl-5-pyrazolone, 1-(4-sulfophenyl)-3-methyl-5-pyrazolone, 1-(4-chlorophenyl)-3-methyl-5-pyrazolone, D-gluconic acid-γ-lactone acetonide, 2,4-thiazolidinedione, 1,4-cyclohexanedione monoethylene acetal, tetrafluorohydroquinone, 4-acetoxyazetidion, 4-N-acetyl-amino-cyclohexanon, 1-phenyl-1,3,8-triazaspiro [4,5] decan-4-one, a copolymer of vinyl acetate and N-vinyl pyrrolidone, testosteronedecanoate, dehydroepiandrosterone, androsterone, testosterone phenylpropionate, dehydroepiandrosterone acetate and stanolone.

5. The fire-extinguishing composition according to claim 1, wherein the auxiliary fire-extinguishing material comprises: brominated flame retardants, chlorinated flame retardants, organophosphorus flame retardants, phosphorus-halogen flame retardants, nitrogen flame retardants, phosphorus-nitrogen flame retardants, inorganic flame retardants or any of their combinations.

6. The fire-extinguishing composition according to claim 1, wherein the additive is one or more of stearate, graphite, sodium silicate, phenolic resin, shellac, starch, dextrin, rubber, epoxy resin, acetal adhesive and hydroxypropyl methyl cellulose.

7. The fire-extinguishing composition according to claim 1, wherein the composition comprises:

i) 49%-85% by mass of the one or more of compounds of i);

ii) 14%-50% by mass of the one or more auxiliary fire-extinguishing compounds; and iii) 1%-5% of the additive.

* * * * *